US006135837A

United States Patent [19]

Giles

[11] Patent Number: 6,135,837

[45] Date of Patent: Oct. 24, 2000

[54] WATER SPORTS BOARD

[76] Inventor: Sean T. Giles, 723 Foxhall Ct., San Marcos, Calif. 92069

[21] Appl. No.: 09/346,666

[22] Filed: Jul. 2, 1999

[51] Int. Cl.[7] ..... B63B 1/00; B63B 35/00; B63B 35/79

[52] U.S. Cl. ..... 441/79; 441/74; 114/39.15

[58] Field of Search ..... 114/271, 286, 114/287, 39.15, 132, 144 R, 65, 74, 75, 79

[56] References Cited

U.S. PATENT DOCUMENTS

| | | | |
|---|---|---|---|
| 3,604,383 | 9/1971 | Ingelman-Sundberg | 114/66.5 |
| 3,902,207 | 9/1975 | Tinkler et al. | 9/310 E |
| 4,638,806 | 1/1987 | Bartlett | 128/400 |
| 4,883,436 | 11/1989 | Oakland | 441/65 |

*Primary Examiner*—S. Joseph Morano
*Assistant Examiner*—Patrick Craig Muldoon
*Attorney, Agent, or Firm*—Charles C. Logan, II

[57] ABSTRACT

A water sports board for use in supporting a person riding along on the top surface of the water. The elongated buoyant board has an elongated slot in its bottom surface for each of its fins. The fins are removably received in the elongated slots when the fins are raised up into the interior of the board. A mechanical structure is utilized for reciprocally moving the fins between an upper position inside the slot and a lower position in which a predetermined portion of the fin extends below the bottom surface of the board. A hydraulic system is used for actuating the mechanical means. It utilizes a resilient compressible bladder that is squeezed or released to move the pin between its upper and lower positions. The water sports board may take the form of a bodyboard, surfboard, kneeboard or wakeboard.

10 Claims, 2 Drawing Sheets

WATER SPORTS BOARD

BACKGROUND OF THE INVENTION

The invention relates to water sports and more specifically to a board that would be ridden on the surface of the water. The sports board could take various forms such as a bodyboard, a kneeboard, a surfboard or a wakeboard. The riders of these various boards might be pulled by a motorboat or may be using the motion of the waves.

Presently, when water sport boards such as those identified above have one or more fins extending from their bottom surface, they aid the rider in traveling in a forward direction or making turns to the left or right. Attempts to make 360 degree spin or other unorthodox horizontal movement results in the fins becoming a hinderance. None of the prior art water sports boards have a system or structure for retracting the fins temporarily so that complicated moves can be attempted by the rider.

It is an object of the invention to provide a novel water sports board having hydraulic means for raising and lowering the fins extending from the bottom surface of the water sports board.

It is also an object of the invention to provide a novel water sports board that has hydraulic means that can be actuated by the rider by squeezing a bladder that would result in the retraction of the fins up into the bottom slots of the water sports board.

It is another object of the invention to provide a novel water sports board that can have mechanical assemblies for raising and lowering the fins easily installed in the water sports board during its manufacturing process.

It is a further object of the invention to provide a novel water sports board that would be economical to manufacture and market.

SUMMARY OF THE INVENTION

The novel water sports board can take many forms. Of primary interest is the bodyboard. However, its novel hydraulic structure and mechanical assemblies can also be incorporated into surfboards, kneeboards, and wakeboards.

The fins of the bodyboard are normally in a lower position beneath the bottom surface of the board. They can be retracted up into slots in the bottom of the board when the rider wishes to do 360 degree turns or other special maneuvers. The manner of raising and lowering the fins relies on a special mechanical assembly for each fin and the use of hydraulic fluid, such as water, to actuate said mechanical assemblies. Each fin has its front end connected to the rear end of a J-shaped pivot arm that is vertically pivoted about a horizontal base. The base has longitudinally spaced vertical walls that extend upwardly from the surface of the base and to which form a channel into which a hydraulic inflation tube is inserted. This hydraulic inflation tube is normally flat in its static state and its ends would be connected to tubular members whose ends have a resilient squeezable bladder attached thereto. The interior of the bladder and the tube members is normally filled with a fluid such as water or some viscous fluid such as a gel while at the same time the hydraulic inflation tube remains empty or flat due to compression forces applied to the hydraulic inflation tube by a spring in the mechanical assembly. The action of squeezing the bladders causes the fluid in them to travel through the tube members and inflate the hydraulic inflation tube which in turn raises the pivot arms resulting in the fin being raised to a horizontal position within the slot in the bottom surface of the board and also compressing the spring in the mechanical assembly. When squeezing pressure on the bladder is released the spring in the mechanical assembly expands causing the pivot arms to travel in the reverse direction to lower the fin into its position down in the water.

The same mechanical assemblies and hydraulic means for actuating the mechanical assemblies can be utilized in surfboards, kneeboards and wakeboards. They would function in the same manner with the basic difference being that a portion of the tube member extends from the top surface of these respective boards and the bladders would be held by the riders while they are either kneeling or standing on the board.

DESCRIPTION OF THE PREFERRED EMBODIMENT

The novel structure of the water sports board will now be described by referring to FIGS. 1–6 of the drawings.

Figure 1:
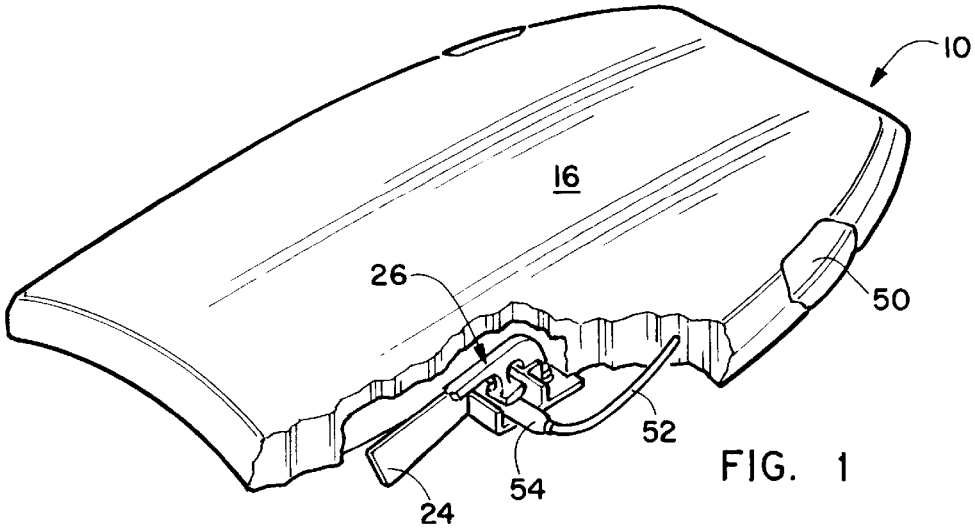
FIG. 1 is a rear perspective view of a bodyboard with portions broken away to illustrate the mechanical and hydraulic structure for raising and lowering its fins.
Figure 2:
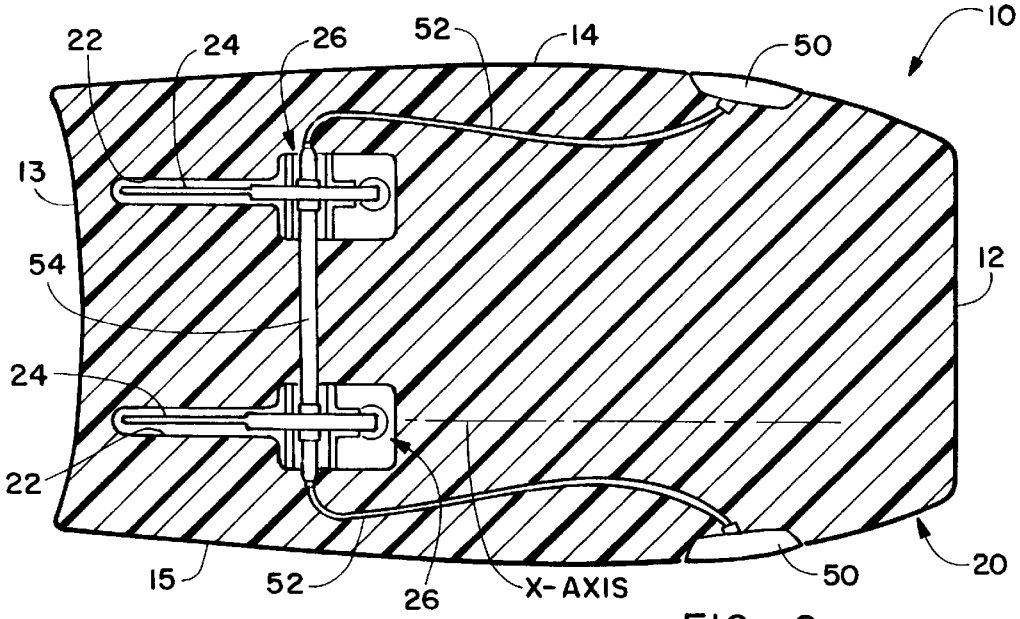
FIG. 2 is a horizontal cross section view of the bodyboard illustrating the mechanical and hydraulic structure utilized to actuate the mechanical structure that raises and lowers the fins of the bodyboard.
Figure 3:
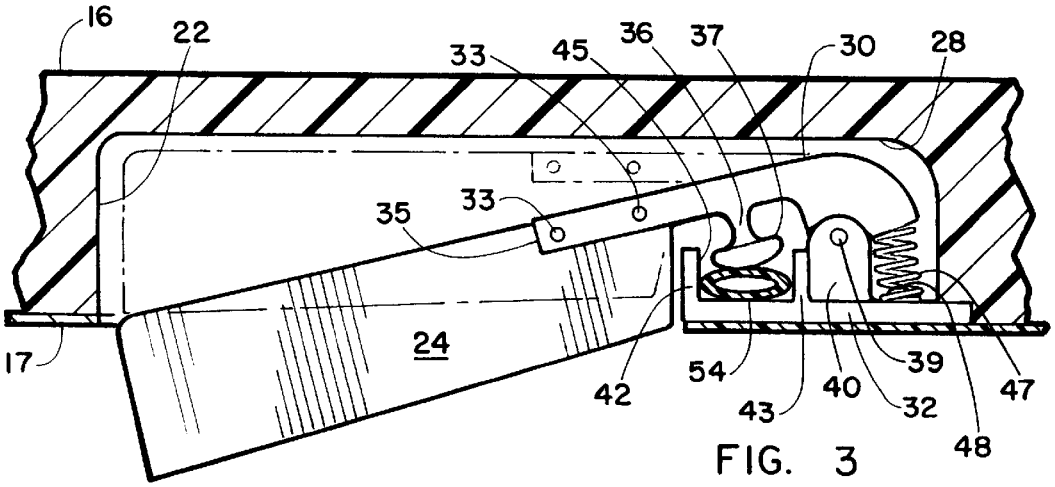
FIG. 3 is a partial vertical cross section view through the body board illustrating the manner in which the fins are raised and lowered.

In FIGS. 1–3, the water sports board takes the form of a bodyboard 10. Bodyboard 10 has a front end 12, a rear end 13, a left edge 14, a right edge 15, a top surface 16 and a bottom surface 17. It has a buoyant board 20 that would be preferably made out of material such as closed-cell thermoplastic, polymer foam plastic material. It could also be made of other suitable buoyant materials.

Bodyboard 10 has a pair of laterally spaced longitudinally extending slots 22 in bottom surface 17. Fins 24 are reciprocally movable between an upper position within slot 22 and a lower position beneath the bottom surface 17. Mechanical assembly 26 provides part of the structure for raising and lowering fins 24. Mechanical assemblies 26 would be mounted in a chamber or cavity 28 in buoyant board 20. Mechanical assembly 26 has a J-shaped pivot arm 30 that is pivotally secured to the base 32. A pair of fasteners 33 secure the front end of fin 24 to the rear end of pivot arms 30. Pivot arms 30 have a bottom surface 35 and extending downwardly therefrom is a neck portion 36 and a pressure head member 37. A pin 39 secures pivot arm 30 to a pair of laterally spaced vertical walls 40 extending upwardly from base 32. The front end of pivot arm 30 has a bump on it that is secured to the top end of coil spring 47. The bottom end of coil spring 47 is secured to bump 48 extending upwardly from the top surface of base 32. Coil spring 47 is not normally under compression and in its extended state forces fin 24 to its downward position.

Base 32 has a longitudinally extending X-axis. A pair of upstanding vertical walls 42 and 43 are longitudinally spaced from each other and they extend laterally to form a channel 45.

The hydraulic system for raising and lowering fins 24 starts with bladders 50 that are connected to tubular members 52 and they in turn are connected to hydraulic inflation tube 54 that is positioned in the respective channels 45. Hydraulic inflation tube 54 in its static state is compressed substantially flat. Prior to assembly of the water sports board a fluid such as water would fill the fluid passageway from both ends of hydraulic inflation tube 54 to the respective bladders 50. Fluids other than water could also be used. Also, tube members 52 could be replaced by molded fluid passage ways that would connect to the respective ends of the bladders and the hydraulic inflation tube 54. Bladders 50 are made of a resilient flexible material that can be easily compressed by the hands of the person riding the body board. This compression transfers the fluid in the bladders 50 into the hydraulic inflation tube and causes it to expand to a substantially circular shape. As this is happening, the top surface of hydraulic inflation tube 54 presses upwardly against the bottom surface of pressure head members 37 causing the pivot arms 30 to lift upwardly and deposit fins 24 into slots 22. Upon release of the finger pressure on bladder 50 by the rider, pivot arms 30 will be forced downwardly by spring 47 and press the water from the hydraulic inflation tube 54 back into the respective bladders 50. This allows the rider of the bodyboard to utilize the fins during normal operation, but allows them to be retracted when doing spins or other tricks.

Figure 4:
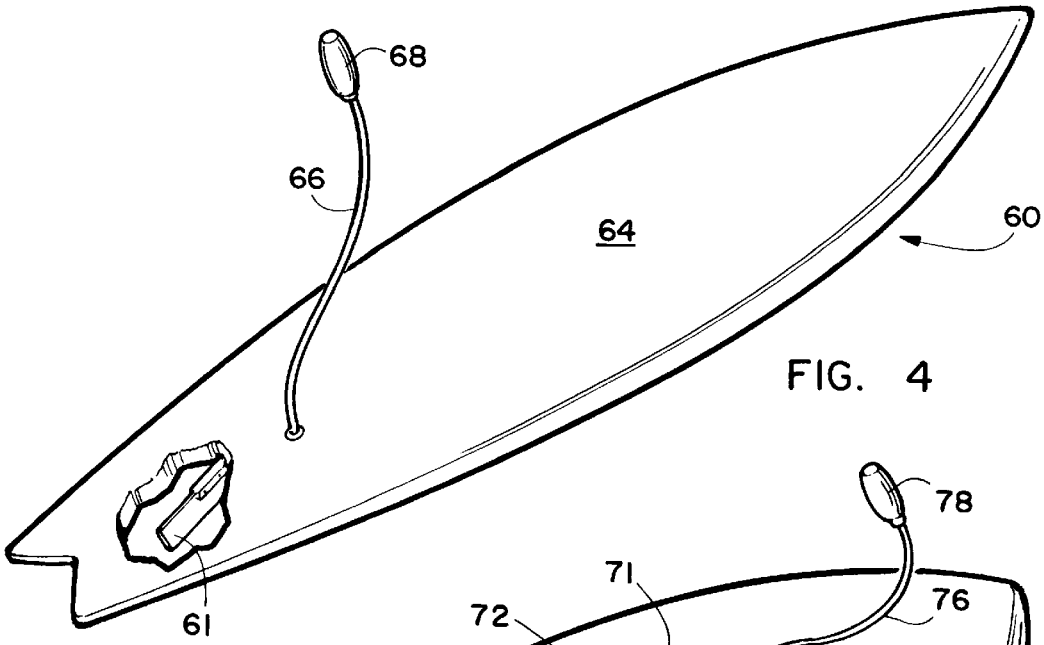
FIG. 4 is a first alternative embodiment illustrating the novel structure adapted to a surfboard for raising and lowering the fin.

A first alternative embodiment is illustrated in FIG. 4 which shows a surfboard 60. It has a fin or fins 61 that would normally be in a down position. The front end of fin 61 would be connected to a mechanical assembly 26 such as illustrated in FIGS. 1–3. Surfboard 60 would also have a tube member 52 connected to a bladder 54 similar to that illustrated in FIG. 2. The portion of tube member 52 that exits the top surface 64 of the surfboard would continue as tubular member 66 and have a squeezable bladder or bulb member 68 at its end. The rider of the surfboard would squeeze bladder 68 whenever he wishes to raise the fin or fins 61 and it would function the same as the hydraulic system discussed previously in describing bodyboard 10.

Figure 5:
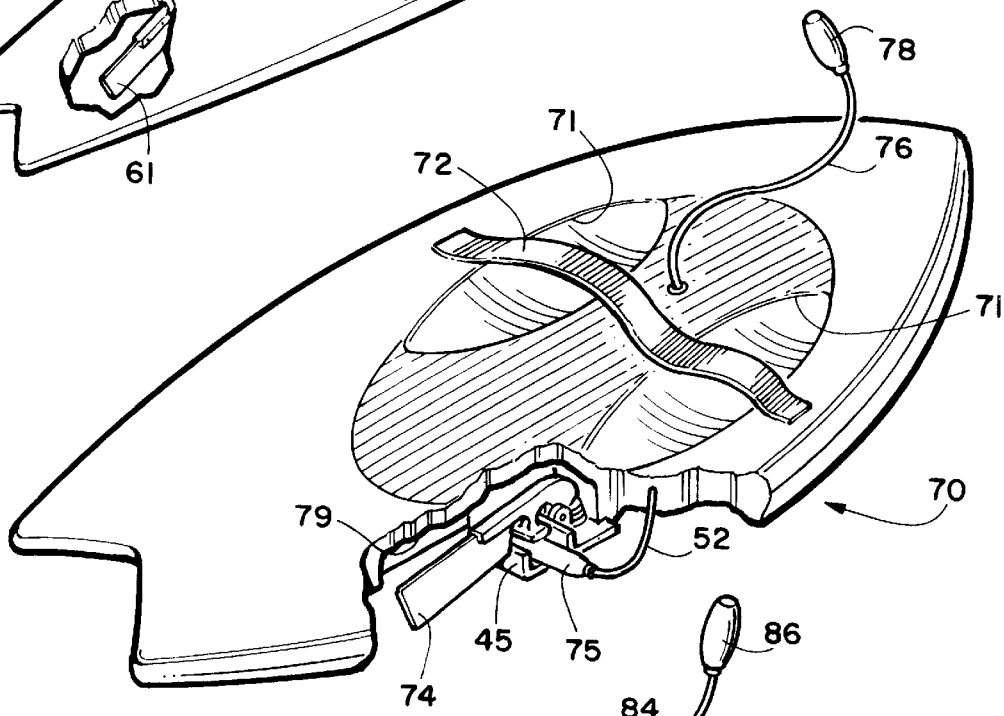
FIG. 5 is a second alternative embodiment illustrating the novel structure adapted to a kneeboard for raising and lowering the fins.

A second alternative embodiment is illustrated in FIG. 5 and it illustrates a kneeboard 70. Its top surface has a pair of laterally spaced recesses 71 in which the rider positions his or her knees. A strap 72 secures the rider to the board. It would have a pair of laterally spaced fins 74 (one of which is illustrated) and would function in the same manner as the hydraulic system of bodyboard 10. It would have an inflatable hydraulic inflation tube 75 that is positioned in the channel 45 of its mechanical assembly 26. Tube member 52 would pass through the interior of the kneeboard and exit its top surface where it becomes tube member 76. It has a squeezable bladder 78 at its top end. Fins 74 would normally be in their lowered position and would be raised by the rider squeezing bladder 78 which causes the fins to retract upwardly into slots 79 in the bottom surface of the kneeboard body.

Figure 6:
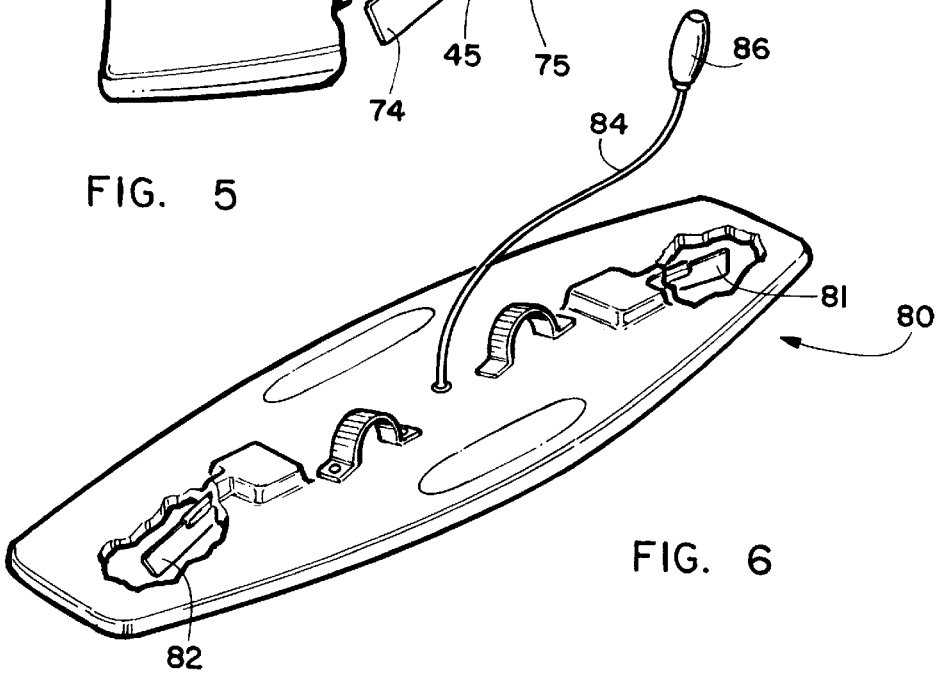
FIG. 6 is a third alternative embodiment illustrating the novel structure adapted to a wakeboard for raising and lowering the fins.

A third alternative embodiment is illustrated in FIG. 6 and it shows a wakeboard 80 having a front fin 81 and a rear fin 82. Each of these fins would be connected to a mechanical assembly 26 mounted in the bottom surface of a wakeboard. Each of the mechanical assemblies 26 would have their own individual hydraulic inflation tubes 54 that would be connected to a tubular member 52 that passes to the center portion of the wakeboard 80 and exits its top surface. That tube member then becomes member 84 and it has a squeezable bladder or bulb 86 at its top end. The wakeboard rider would normally ride with the fins down and squeeze the bladder 86 when he wishes to raise the respective fins for doing special maneuvers. Upon release of the pressure on the bladder 86, the respective fins would be forced back to their normal lower position by coil springs 47.

The water sports boards have been illustrated in four embodiments. They would have a length L1 in the range of 2 feet–11 feet. They would have a width W1 in the range of 18 inches–36 inches and a thickness T1 in the range of 1–4 inches.

What is claimed is:

1. A water sports board for use in supporting a person riding along on the top surface of the water comprising:

an elongated buoyant board having a length L1, a width W1, and a thickness T1; said buoyant board having a top surface, an interior, a bottom surface, a front end, a rear end, a left edge and a right edge;

at least one elongated fin having a front end, a rear end, a top edge and a bottom edge;

an elongated slot in said bottom surface of said buoyant board for each of said fins for reciprocally receiving said fins when they are raised up into said interior of said buoyant board;

mechanical means for reciprocally moving said fin between an upper position inside said slot in said buoyant board and a lower position in which a predetermined portion of said fin extends below said bottom surface of said buoyant board; and hydraulic means for actuating said mechanical means; said hydraulic means having a resilient compressible bladder in a closed fluid system that is squeezed or released to instantaneously on demand move said fin between said upper and lower positions.

2. A water sports board as recited in claim 1 wherein said closed fluid system further comprises a hydraulic inflation tube that is connected by a fluid passageway to said compressible bladder whereby squeezing compresses said bladder and instantaneously on demand transfers fluid from said bladder and pumps up said hydraulic inflation tube.

3. A water sports board as recited in claim 1 wherein said buoyant board is a surfboard and part of said hydraulic means for actuating said mechanical means is a flexible hose external to said buoyant board whose end is connected to said resilient compressible bladder that the rider of the surfboard would squeeze to retract said fin.

4. A water sports board as recited in claim 1 wherein said buoyant board is a kneeboard and part of said hydraulic means for actuating said mechanical means is a flexible hose external to said buoyant board whose end is connected to said resilient compressible bladder that the rider of the kneeboard would squeeze to retract said fin.

5. A water sports board as recited in claim 1 wherein said buoyant board is a wakeboard and part of said hydraulic means for actuating said mechanical means is a flexible hose external to said buoyant board whose end is connected to said resilient compressible bladder that the rider of the wakeboard would squeeze to retract said fin.

6. A water sports board for use in supporting a person riding along on the top surface of the water comprising:

an elongated buoyant board having a length L1, a width W1, and a thickness T1; said buoyant board having a top surface, an interior, a bottom surface, a front end, a rear end, a left edge and a right edge;

at least one elongated fin having a front end, a rear end, a top edge and a bottom edge;

an elongated slot in said bottom surface of said buoyant board for each of said fins for reciprocally receiving said fins when they are raised up into said interior of said buoyant board;

mechanical means for reciprocally moving said fin between an upper position inside said slot in said buoyant board and a lower position in which a predetermined portion of said fin extends below said bottom surface of said buoyant board; said mechanical means comprises an elongated pivot arm having a front end, a rear end, and a bottom surface; said rear end of said pivot arm being fastened to said front end of said fin; a base and means for pivotally securing said front end of said pivot arm to said base; and hydraulic means for actuating said mechanical means; said hydraulic means having a resilient compressible bladder that is squeezed or released to move said fin between said upper and lower positions; said hydraulic means further comprises a hydraulic inflation tube that is connected by a fluid passageway to said compressible bladder whereby compression of said bladder transfers fluid from said bladder and pumps up said hydraulic inflation tube.

7. A water sports board as recited in claim 6 further comprising head pressure members extending downwardly from said bottom surface of said pivot arm for collapsing said hydraulic inflation tube and thus lowering said fin to its lower position.

8. A water sports board as recited in claim 7 wherein said base has a longitudinally extending x-axis and has a top surface; a pair of longitudinally spaced transversely extending walls extend up from said top surface to form a channel for receiving said hydraulic inflation tube.

9. A water sports board as recited in claim 6 wherein said water sports board has a second fin having a front end and said mechanical means has a second elongated pivot arm that is fastened to said front end of said second fin.

10. A water sports board as recited in claim 9 further comprising a tie-rod that connects said two pivot arms together so that they pivot as a single unit.

* * * * *